US010176790B2

(12) United States Patent
Gangi

(10) Patent No.: US 10,176,790 B2
(45) Date of Patent: Jan. 8, 2019

(54) GUITAR SUPPORT

(71) Applicant: The Penn State Research Foundation, University Park, PA (US)

(72) Inventor: Jonathan J. Gangi, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 15/873,460

(22) Filed: Jan. 17, 2018

(65) Prior Publication Data

US 2018/0204553 A1 Jul. 19, 2018

Related U.S. Application Data

(60) Provisional application No. 62/447,131, filed on Jan. 17, 2017.

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS

| | | | | |
|---|---|---|---|---|
| 2,547,924 | A | 4/1951 | Citro | |
| 2,559,200 | A | 7/1951 | Schaf | |
| 8,530,733 | B2 * | 9/2013 | Bibb | G10G 5/005 84/327 |
| 2003/0121395 | A1 * | 7/2003 | Smith | G10G 5/005 84/327 |
| 2009/0229445 | A1 * | 9/2009 | Courtright | G10D 1/005 84/453 |

OTHER PUBLICATIONS

Dynarette Guitar Support Cushion; URL: http://www.vamu.se/.

* cited by examiner

*Primary Examiner* — Kimberly Lockett
(74) *Attorney, Agent, or Firm* — Dinsmore & Shohl LLP

(57) ABSTRACT

A guitar support for supporting a guitar during a performance includes a base, a stand having an upper portion, a lower portion, and a curved middle portion. A lower end of the lower portion is connected to the base. A shaped support element is connected to a top end of the upper portion, the shaped support element having a top surface shaped to support a guitar body.

9 Claims, 6 Drawing Sheets

GUITAR SUPPORT

REFERENCE TO RELATED APPLICATION

This application claims priority from U.S. Provisional Patent Application Ser. No. 62/447,131, filed Jan. 17, 2017, the entire content of which is incorporated herein by reference.

FIELD OF THE INVENTION

The present invention relates to a guitar support, in particular, to a guitar support to help hold a guitar during a guitarist's practice or performance.

BACKGROUND OF THE INVENTION

Typically, classical, jazz, and acoustic guitarists hold the guitar by placing the left foot on a footstool, as seen in FIG. 2. The problem is that this is an ergonomically unhealthy position which may cause back and hip problems with prolonged practice time, and may also cause neurological damage.

When guitarists practice for long hours or perform in front of a crowd, it is necessary to have a guitar support that is ergonomic, non-invasive and supportive. There are not any guitar supports on the market that meet all three criteria.

SUMMARY OF THE INVENTION

This present invention provides a guitar support with the security and stability of the traditional footstool, yet is ergonomically healthy, aesthetically pleasing, and functional, allowing for extended hours and years of pain free guitar practicing, teaching, and performing. The guitar support of the present invention is to allow the guitarist to sit up straight with both feet on the floor while playing the guitar in order to prevent back complications.

In one embodiment, the guitar support of the present invention includes a base, a stand or a post and a shaped support element. The stand includes a top end, a lower end. The stand further includes a top portion, a lower portion and a curved middle portion. The lower end of the stand is connected to the base. The shaped support element is connected to the top end of the stand and has a top surface shaped to support a guitar body.

In an embodiment, the lower portion of the post may be height-adjustable and the upper portion of the post may be height-adjustable. The upper portion of the post may be flexible or have a connection that allows an orientation of the shaped element to be adjustable.

The top surface of the shaped support element may include a material that grips to a surface of a guitar body.

In another version, the shaped element may take the form of a cushion having a curved top surface for a guitar body to rest upon.

In an embodiment, the lower portion of the post has a height which is tall enough such that the curved middle portion is curved around a player's thigh when the player is sitting.

In some embodiments, the curved middle portion of the guitar support may have a radius in the range of 2 to 10 inches.

In some embodiments, the guitar support may have a total height in the range of 24 to 36 inches.

DETAILED DESCRIPTION OF THE INVENTION

Figure 1:
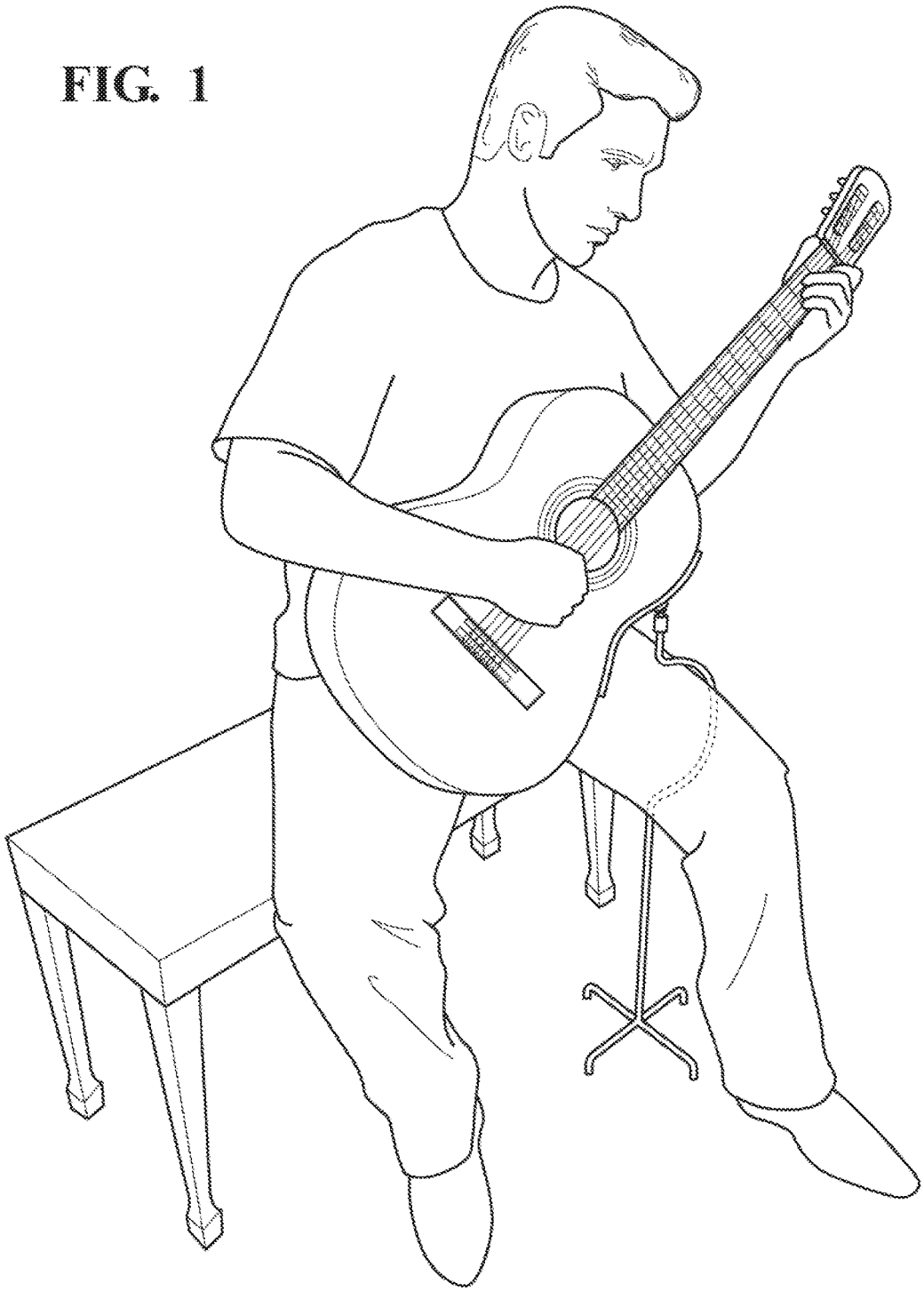
FIG. 1 is a schematic view of showing a guitarist holding a guitar using a guitar support according to an embodiment of the present invention.
Figure 2:
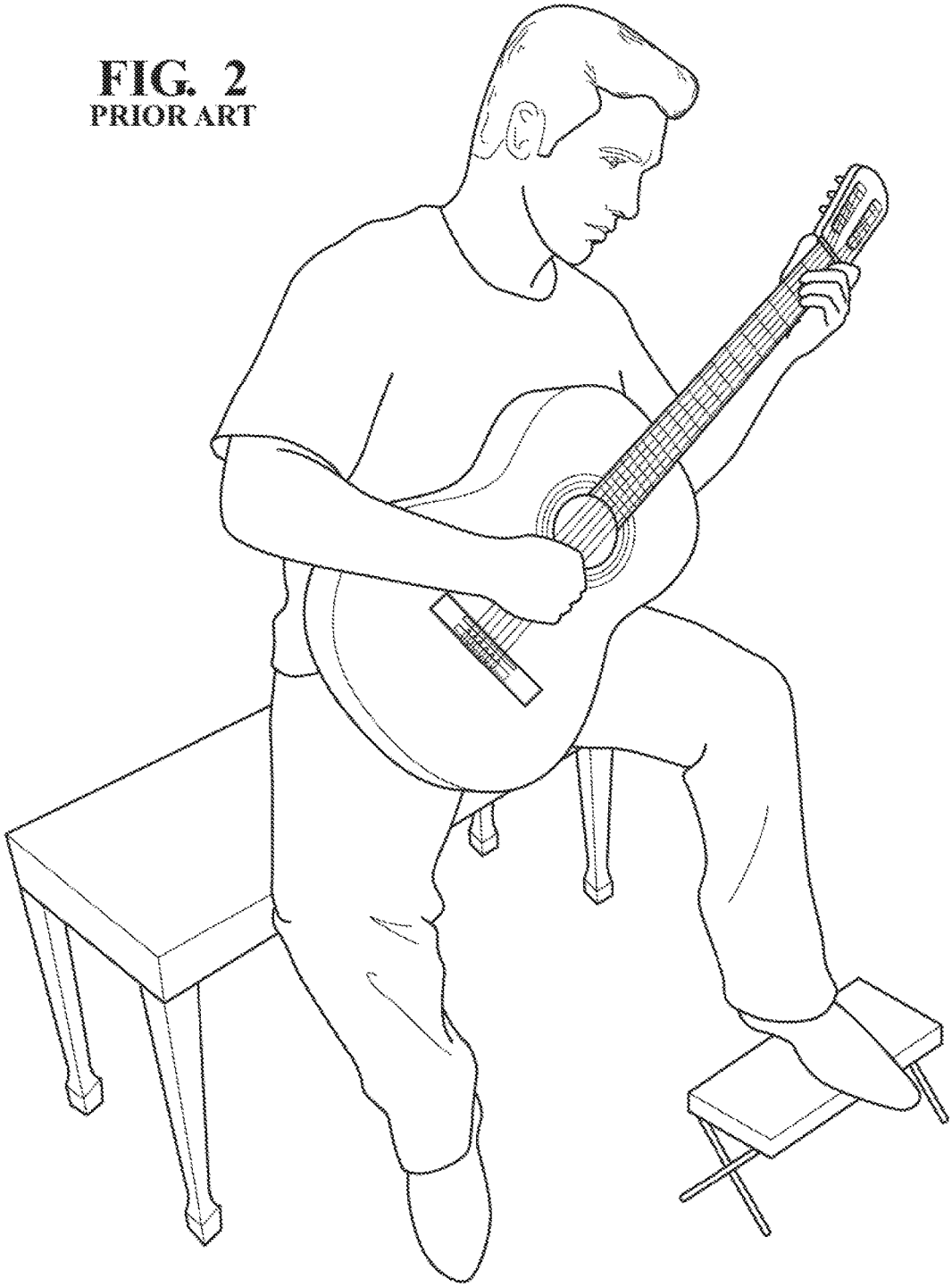
FIG. 2 PRIOR ART
FIG. 2 is a schematic view of a conventional way of guitarists holding a guitar by placing his left foot on a footstool.

FIG. 1 shows a schematic view of how a guitar support may be used in accordance with an embodiment of the present invention. In contrast with the prior art shown in FIG. 2, where the left foot is resting on a foot stool to elevate the left thigh in order to support the guitar, the player's left foot is firmly supported on the floor, but the guitar is elevated to a desired height by using a guitar support. The guitar support includes a curved section that curves around the player's left thigh.

Figure 3:
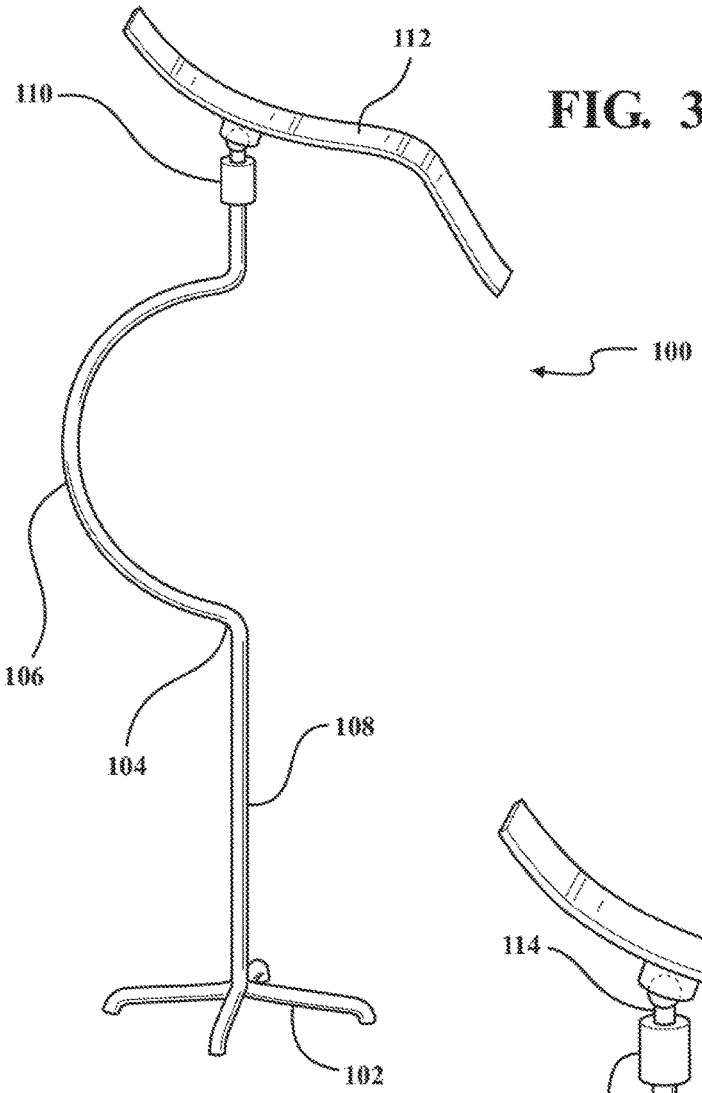
FIG. 3 is a perspective view of a guitar support in accordance with one embodiment of the present invention.

FIG. 3 is a perspective view of a guitar support in accordance with one embodiment of the present invention. In this embodiment, the guitar support 100 includes a four-legged base, a stand and a shaped support element 112 attached to the top of the stand. The base 102 may take other suitable shapes that are configured to provide the stability of the guitar support. For example, the base may be a three-legged base. It may also be a solid piece of any suitable shape. The stand includes a generally upright lower portion 108 adjacent to the base 102, a generally upright upper portion 110 adjacent to the shaped support element 112, and an offset portion 106 in the middle. The upright lower portion 108 may be mounted to the base or may be an integral part of the base. The top of the upright lower portion 108 transitions to the offset portion 106 via a round corner 104. Similarly, the bottom of the generally upright upper portion 110 transitions the offset portion 106 via a round corner.

In another embodiment, the upper portion 108 and the lower portion 110 may be slightly inclined relative to the base 102. The upper portion 108 and the lower portion 110 may be tilted towards the player such that the shaped support element 112 may be tilted towards the player. The stand does not have to be upright as long as the structure is balanced with and without a guitar being supported on the shaped support element.

The offset portion 106 allows the musician to place the support behind the leg and provides clearance over the thigh, which allows the guitar to rest upon the shaped support element 112. The offset portion 106 may take any shapes, such as circular, oval, square, angled, irregular, as long as the shape provides a clearance for a player's thigh. The clearance may be adjustable based on the size of the player. In certain embodiments, the size of the clearance is in the range of two to ten inches.

The generally upright upper portion 110 adjacent to the shaped support element 112 is flexible such that the orientation of the shaped support element 112 can be adjusted when attached to the stand. Alternatively, the generally upright upper portion 110 may include a spherical wheel connection 114 with the shaped support element 112, such that the shaped support element 112 can be oriented in various directions.

The stand can be made of separate components and then assembled together. Alternatively, the stand may also be manufactured into one integrated piece.

The shaped support element 112 is shaped like a cradle and takes the place of the player's thigh for supporting a guitar. When a player is playing the guitar, the guitar can be placed upon and thereby be supported by the shaped support element 112.

The generally upright upper portion 110 and the generally upright upper portion 108 may be aligned or not aligned, as long as the geometry of the stand is stable such that the stand does not tip over with or without a guitar resting on it.

Figure 4:
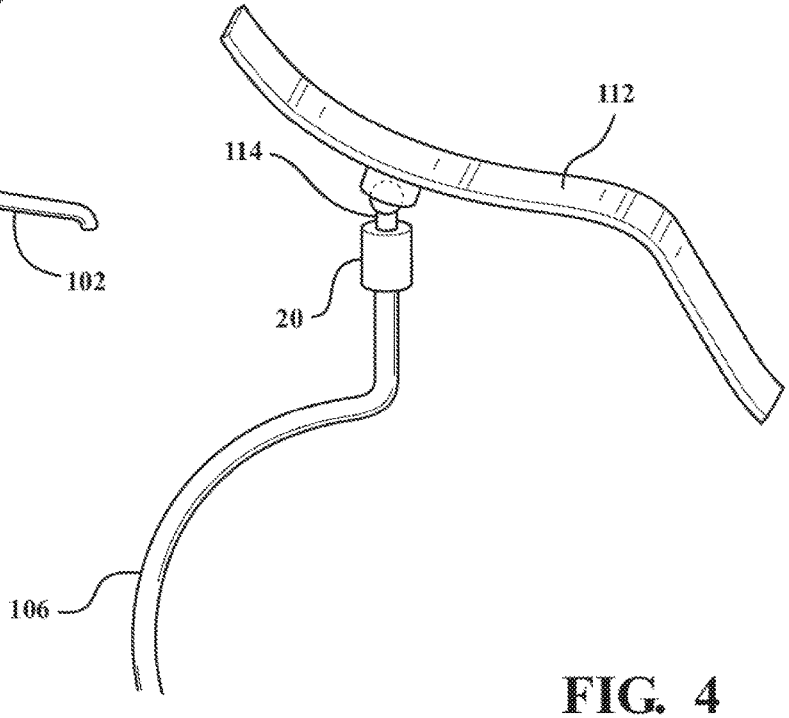
FIG. 4 is an elevational view showing a portion of the guitar support in accordance with one embodiment of the present invention.

FIG. 4 shows a closer view of the shaped support element 112. As shown in FIG. 4, the shaped support element 112 is a shaped flat sheet which conforms to the shape of a guitar body such that a guitar can rest upon and be cradled by the shaped flat sheet while the player is playing the guitar. The shaped support element 112 includes an upper surface and a lower surface. The upper surface includes a concave portion and a convex portion seamlessly connected together, which is designed to conform to the shape of the side of a guitar.

The upper surface of the shaped support element 112 may include a material that can grip to the surface of the guitar body to prevent the movement of the guitar relative to the guitar support. The material may be rubber, polymer, or any suitable material which can provides friction so that the support guitar does not slip off. As shown in FIGS. 3 and 4, the stand may include an adjustable shaft 20 in order to fit musicians with different heights. The adjustable shaft may be located at the lower upright portion adjacent to the base or at the portion adjacent to the shaped support element.

Figure 5:
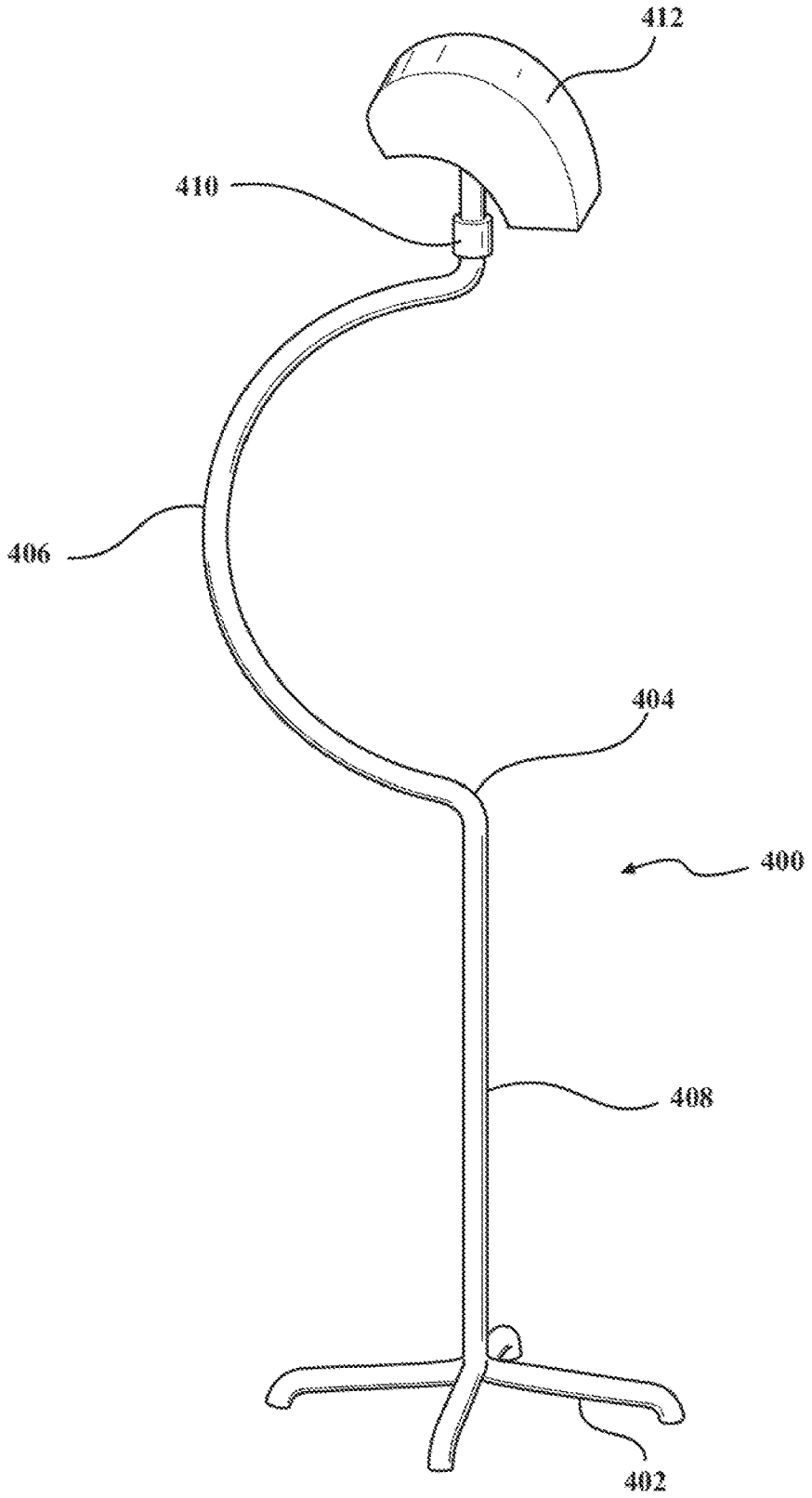
FIG. 5 is a perspective view of a guitar support in accordance with another embodiment of the present invention.

FIG. 5 shows a guitar support in accordance with another embodiment of the present invention. In this embodiment, the shaped support element is replaced by a cushion 412 attached to the top of the stand. The cushion 412 has an upper surface upon which a guitar can rest. The upper surface may take the shape of a convex, or any suitable shape that will mate with the side of a guitar such that the guitar can be supported. The top surface of the cushion may also include a type of material that grips to the surface of a guitar body such that the guitar does not slide or otherwise move relative to the guitar support during the practice or performance.

Figure 6:
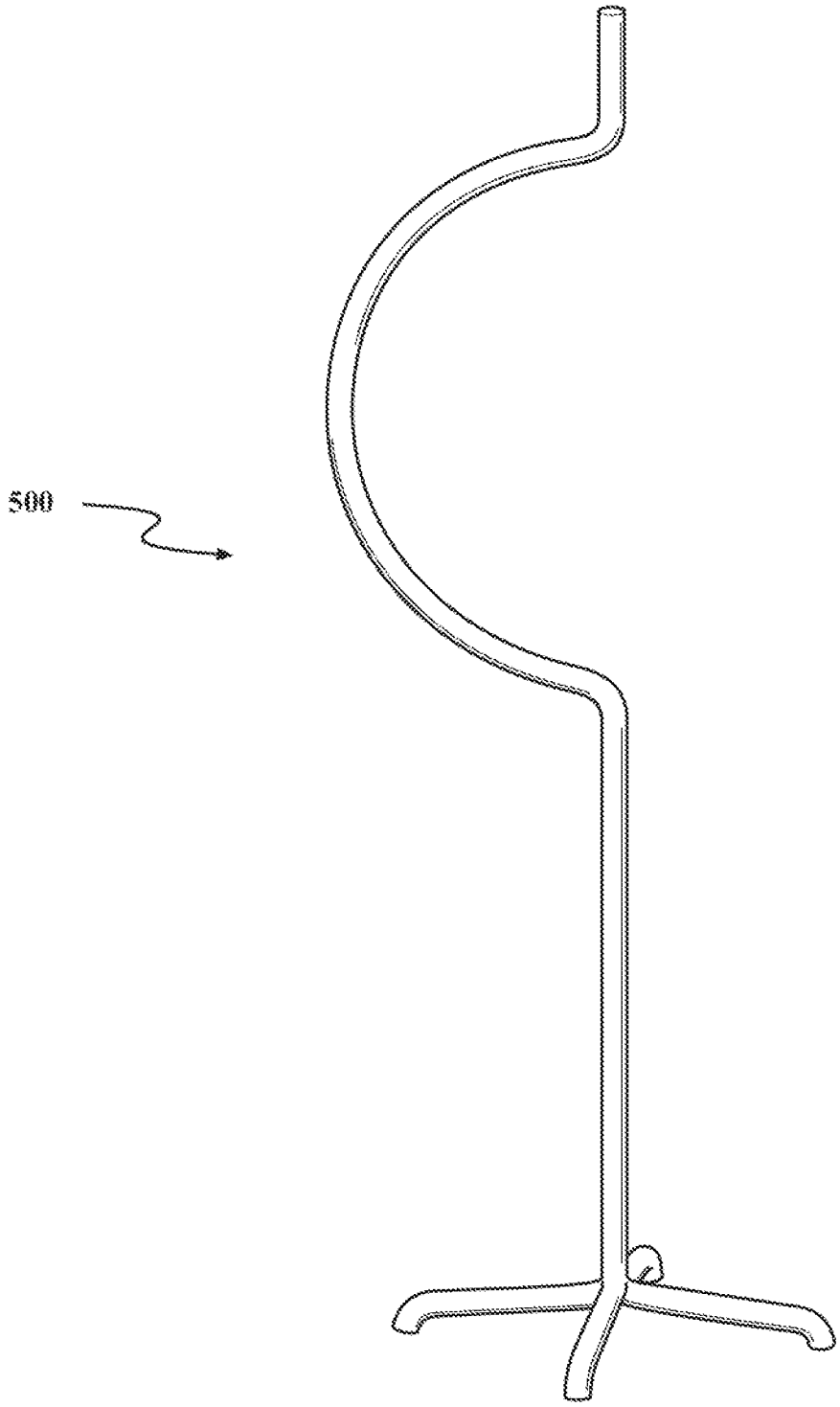
FIG. 6 is a perspective view of a portion of a guitar support in accordance with an embodiment of the present invention.
Figure 7:
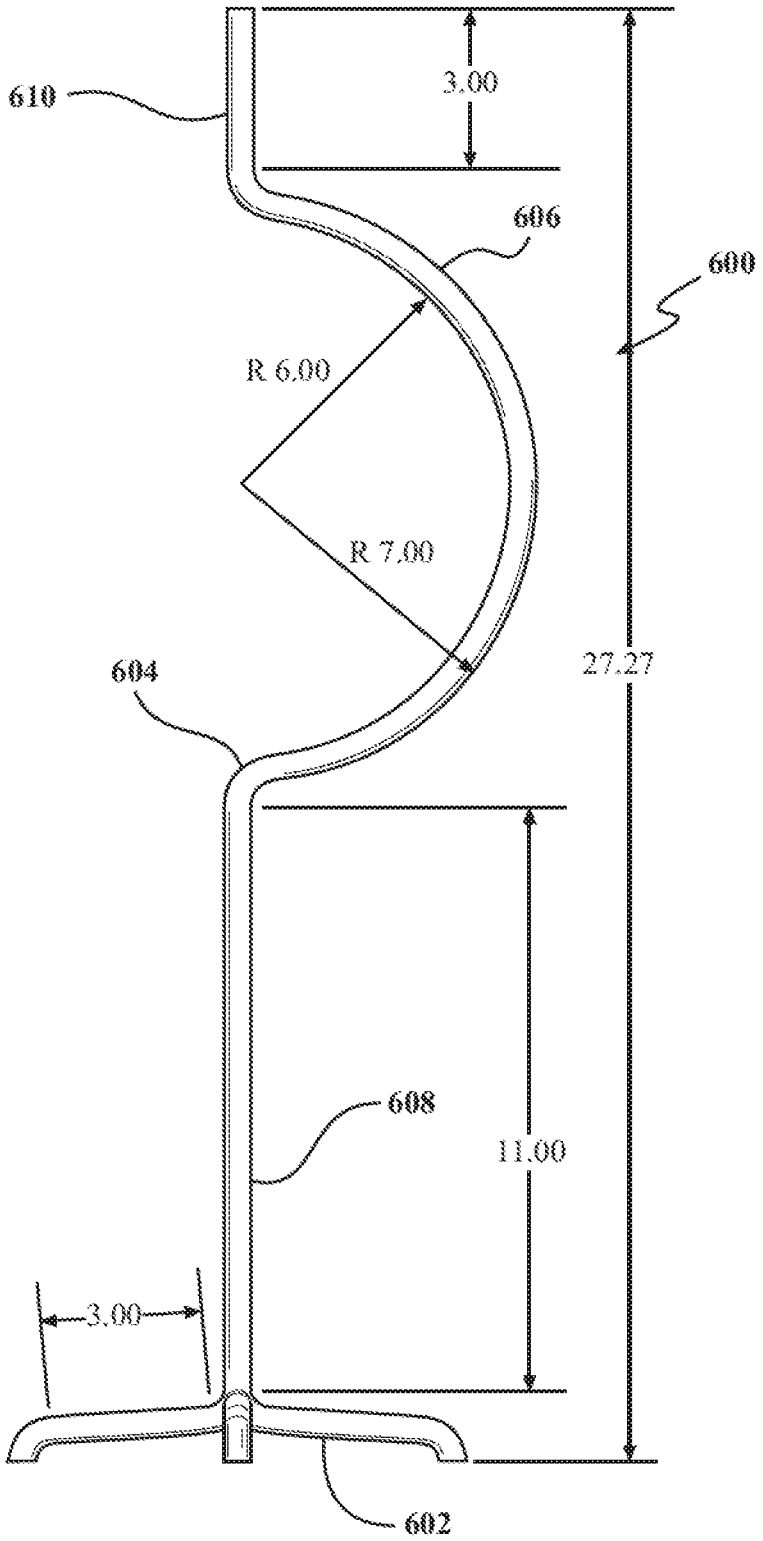
FIG. 7 is an elevational view of the guitar support shown in FIG. 5, including some exemplary dimensions.

FIG. 6 shows a guitar support in accordance with an embodiment of the present invention before a shaped element or cushion is installed. FIG. 7 shows a detailed configuration and some exemplary dimensions of the guitar support in FIG. 6. In one version, each leg of the base measures 3 inches long. The upright lower portion adjacent to the base measures 11 inches tall. The generally upright upper portion measures 3 inches tall. The curved portion in the middle has a radius of 6 inches. The curved portion in the middle is connected to each of the upright lower portion and upper portion via a curved connection piece 604. The curved connection piece 604 has a radius of about 1 inch. The total height of the stand on the base measures about 27 inches tall. In certain embodiments, a total height of the stand ranges between 24 and 36 inches tall.

As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the invention.

The invention claimed is:

1. A guitar support for supporting a guitar during practice or a performance, comprising:

a base;

a post having an upper portion, a lower portion, and a curved middle portion, a lower end of the post connected to the base; and a shaped support element connected to a top end of the post, the shaped element having a top surface shaped to support a guitar body;

wherein the lower portion of the post has a height which is tall enough such that the curved middle portion is around a player's thigh when the player is sitting.

2. The guitar support according to claim 1, wherein the lower portion of the post is height-adjustable.

3. The guitar support according to claim 1, wherein the upper portion of the post is height-adjustable.

4. The guitar support according to claim 1, wherein the upper portion of the post is flexible such that an orientation of the shaped element is adjustable.

5. The guitar support according to claim 1, wherein the top surface of the shaped support element includes a material that grips to a surface of a guitar body.

6. The guitar support according to claim 1, wherein the shaped support element is a cushion having a curved top surface.

7. The guitar support according to claim 1, wherein the curved middle portion has a radius in the range of 2 to 10 inch.

8. The guitar support according to claim 1, wherein the guitar support has a height in the range of 24 to 36 inch.

9. The guitar support according to claim 1, wherein the upper portion is a straight portion which is generally upright.

* * * * *